US008597003B2

(12) United States Patent
Krug et al.

(10) Patent No.: US 8,597,003 B2
(45) Date of Patent: Dec. 3, 2013

(54) DIRECT CONTROL VARIABLE DISPLACEMENT VANE PUMP

(75) Inventors: Peter Krug, Richmond Hill (CA); Vasilios B. Liavas, Toronto (CA); Gurvinder Bhogal, Brampton (CA)

(73) Assignee: Magna Powertrain Inc., Concord (CA)

( * ) Notice: Subject to any disclaimer, the term of this patent is extended or adjusted under 35 U.S.C. 154(b) by 993 days.

(21) Appl. No.: 12/575,756

(22) Filed: Oct. 8, 2009

(65) Prior Publication Data

US 2010/0086424 A1 Apr. 8, 2010

Related U.S. Application Data

(60) Provisional application No. 61/103,593, filed on Oct. 8, 2008.

(51) Int. Cl.

| | |
|---|---|
| ***F03C 4/00*** | (2006.01) |
| ***F04C 2/00*** | (2006.01) |
| ***F04C 14/18*** | (2006.01) |

(52) U.S. Cl.

USPC ..... 418/30; 418/24; 418/26; 418/259; 417/220; 403/141; 403/143

(58) Field of Classification Search

USPC ..... 418/24, 26–30, 259; 417/218–222; 403/141–143

See application file for complete search history.

(56) References Cited

U.S. PATENT DOCUMENTS

| | | | | |
|---|---|---|---|---|
| 3,323,382 | A * | 6/1967 | Ruschmann | 74/127 |
| 4,259,039 | A * | 3/1981 | Arnold | 418/26 |
| 4,325,215 | A * | 4/1982 | Yamamoto | 418/26 |
| 4,666,330 | A * | 5/1987 | O'Connell | 403/143 |
| 5,048,474 | A * | 9/1991 | Matayoshi et al. | 123/90.18 |
| 5,702,242 | A | 12/1997 | Nied-Menninger et al. | |
| 5,807,090 | A | 9/1998 | Agner | |
| 5,975,868 | A | 11/1999 | Agner | |
| 6,120,270 | A | 9/2000 | Parsch | |
| 6,152,716 | A | 11/2000 | Agner | |
| 6,164,928 | A | 12/2000 | Agner | |
| 6,227,816 | B1 | 5/2001 | Brener et al. | |
| 6,234,775 | B1 | 5/2001 | Agner et al. | |
| 6,244,830 | B1 | 6/2001 | Agner | |
| 6,413,063 | B1 | 7/2002 | Parsch et al. | |
| 6,485,277 | B2 | 11/2002 | Agner et al. | |
| 6,561,155 | B1 | 5/2003 | Williams | |
| 6,896,489 | B2 | 5/2005 | Hunter et al. | |
| 7,018,178 | B2 | 3/2006 | Hunter et al. | |
| 7,344,361 | B2 | 3/2008 | Kiefer | |
| 8,128,386 | B2 * | 3/2012 | Veilleux, Jr. | 418/30 |

* cited by examiner

*Primary Examiner* — Theresa Trieu

(74) *Attorney, Agent, or Firm* — Harness, Dickey & Pierce, P.L.C.

(57) ABSTRACT

A lubrication system for a power transmission device includes a variable displacement vane pump including a moveable control ring for varying the displacement of the pump. A linear actuator directly acts on the control ring for moving the control ring between maximum and minimum pump displacement positions. The linear actuator includes an electric motor for rotating a drive member. The drive member engages a driven actuator shaft to cause linear translation of the actuator shaft in response to rotation of the drive member. A control system includes a controller for signaling the actuator to extend or retract the actuator shaft to vary the pump displacement.

22 Claims, 8 Drawing Sheets

DIRECT CONTROL VARIABLE DISPLACEMENT VANE PUMP

CROSS-REFERENCE TO RELATED APPLICATIONS

This application claims the benefit of U.S. Provisional Application No. 61/103,593, filed on Oct. 8, 2008. The entire disclosure of the above application is incorporated herein by reference.

FIELD

The present disclosure relates to variable displacement vane pumps. More specifically, the present invention relates to a variable displacement vane pump and system whose output flow is continuously variable and which can be selected independent of the operating speed of the pump.

BACKGROUND

Mechanical systems, such as internal combustion engines and automatic transmissions, typically include a lubrication pump to provide lubricating oil, under pressure, to many of the moving components and/or subsystems of the mechanical systems. In most cases, the lubrication pump is driven by a rotating component of the mechanical system and thus the operating speed and output of the pump varies with the operating speed of the mechanical system. The lubrication requirements of the mechanical system do not directly correspond to the operating speed of the mechanical system.

To deal with these differences, prior art fixed displacement lubricating pumps were generally designed to operate effectively at a target speed and a maximum operating lubricant temperature resulting in an oversupply of lubricating oil at most mechanical system operating. A pressure relief valve was provided to return the surplus lubricating oil back into the pump inlet or oil sump to avoid over pressure conditions in the mechanical system. In some operating conditions such as low oil temperatures, the overproduction of pressurized lubricating oil can be 500% of the mechanical system's needs. The result is a significant amount of energy being used to pressurize the lubricating oil which is subsequently exhausted through the relief valve.

More recently, variable displacement vane pumps have been employed as lubrication oil pumps. Such pumps generally include a control ring, or other mechanism, which can be operated to alter the volumetric displacement of the pump and thus its output at an operating speed. Typically, a feedback mechanism is supplied with pressurized lubricating oil from the output of the pump to alter the displacement of the pump to operate and to avoid over pressure situations in the engine throughout the expected range of operating conditions of the mechanical system.

While such variable displacement pumps provide some improvements in energy efficiency over fixed displacement pumps, they still result in a significant energy loss as their displacement is controlled, directly or indirectly, by the output pressure of the pump which changes with the operating speed of the mechanical system, rather than with the changing requirements of the lubrication system. Accordingly, such variable displacement pumps must still be designed to provide oil pressures which meet the highest expected mechanical system requirements, despite operating temperatures and other variables, even when the mechanical system operating conditions normally do not necessitate such high requirements.

Another variable displacement pump control system is described within U.S. Pat. No. 7,018,178. The control system includes an electrical solenoid coupled to a variable displacement pump for varying the displacement of the pump during engine operation. While an electric solenoid may provide an additional degree of pump control, several disadvantages from its use exist. In particular, a solenoid requires a continuous supply of current to keep it active through operation of the pump. The use of the electrical power offsets the benefit of controlling the pump to minimize the amount of time where the pump provides excess lubricant flow. Furthermore, the maximum force capability of the solenoid is limited by the size of the electromagnet and the current applied thereto. For certain applications, the size of the electromagnet required to provide the desired force may be prohibitive for packaging the solenoid within an automotive environment. Accordingly, a need exists for an improved lubrication system capable of producing a desired lubricant flow while minimizing the energy required to do so.

SUMMARY

This section provides a general summary of the disclosure, and is not a comprehensive disclosure of its full scope or all of its features.

A lubrication system for a power transmission device includes a variable displacement vane pump including a moveable control ring for varying the displacement of the pump. A linear actuator directly acts on the control ring for moving the control ring between maximum and minimum pump displacement positions. The linear actuator includes an electric motor for rotating a drive member. The drive member engages a driven actuator shaft to cause linear translation of the actuator shaft in response to rotation of the drive member. A control system includes a controller for signaling the actuator to extend or retract the actuator shaft to vary the pump displacement.

Furthermore, a lubrication system for a power transmission device includes a variable displacement vane pump having a pivotable pump control ring for varying the displacement of the pump. A control system is operable to vary the displacement of the pump during operation of the pump to achieve an output pressure selected from a continuously variable range of output pressures from the pump which are independent from the operating speed of the pump. The control system includes a linear actuator coupled to the control ring for moving the control ring between minimum and maximum pump displacement positions. The linear actuator includes an electric stepper motor for bi-directionally rotating a nut threadingly engaged with an axially moveable actuator shaft. A coupler interconnects the shaft and the control ring and has multiple degrees of freedom to allow concurrent axial movement of the actuator shaft and rotation of the control ring.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
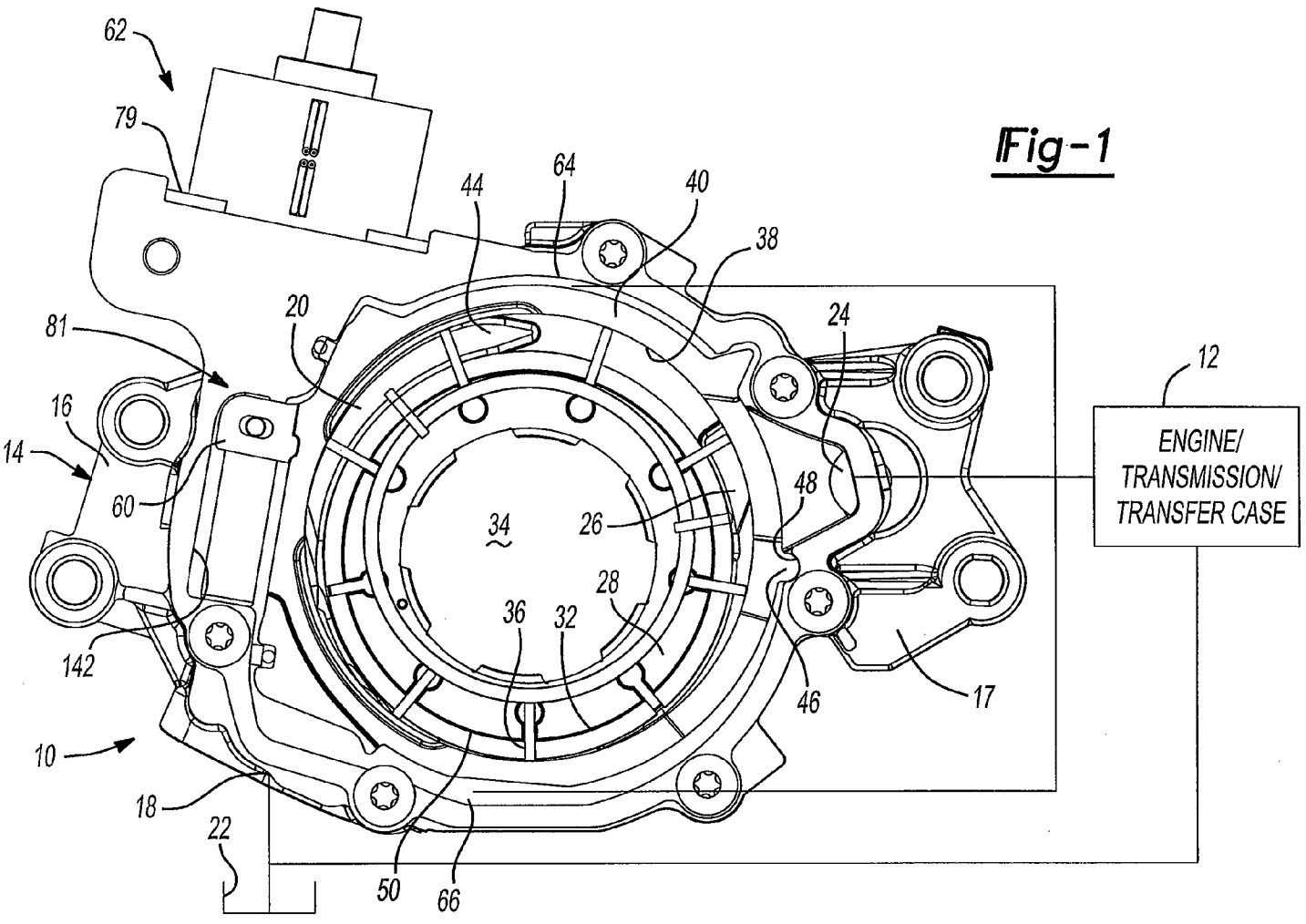
FIG. 1 is a cross-sectional view of an exemplary directly controlled variable displacement vane pump.
Figure 2:
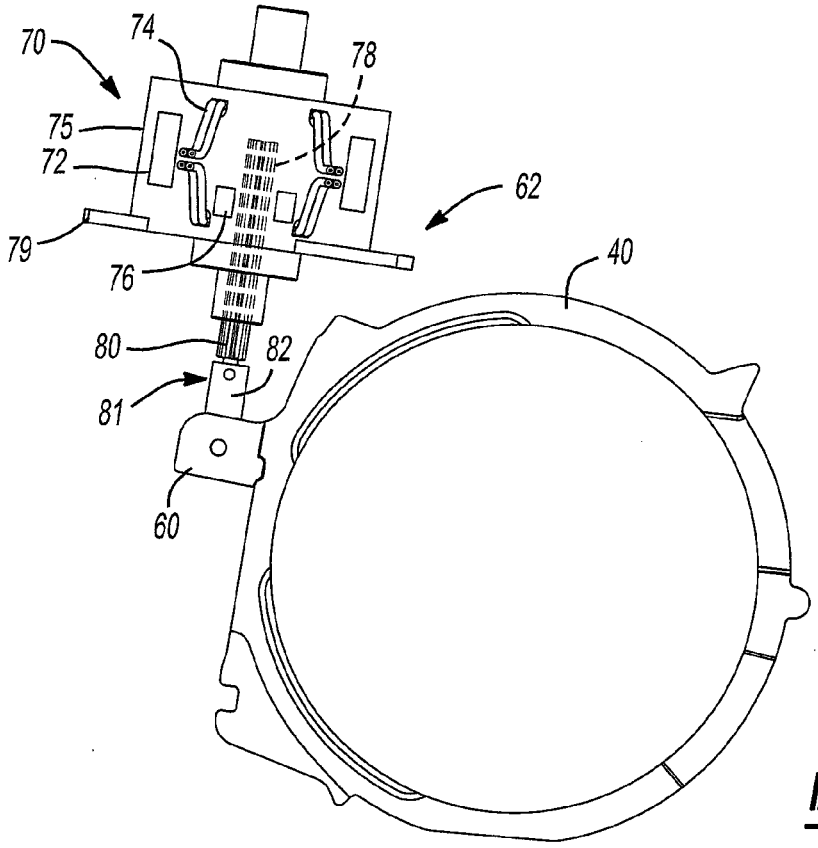
FIG. 2 is a sectional view of a portion of the pump and actuator assembly shown in FIG. 1.
Figure 3:
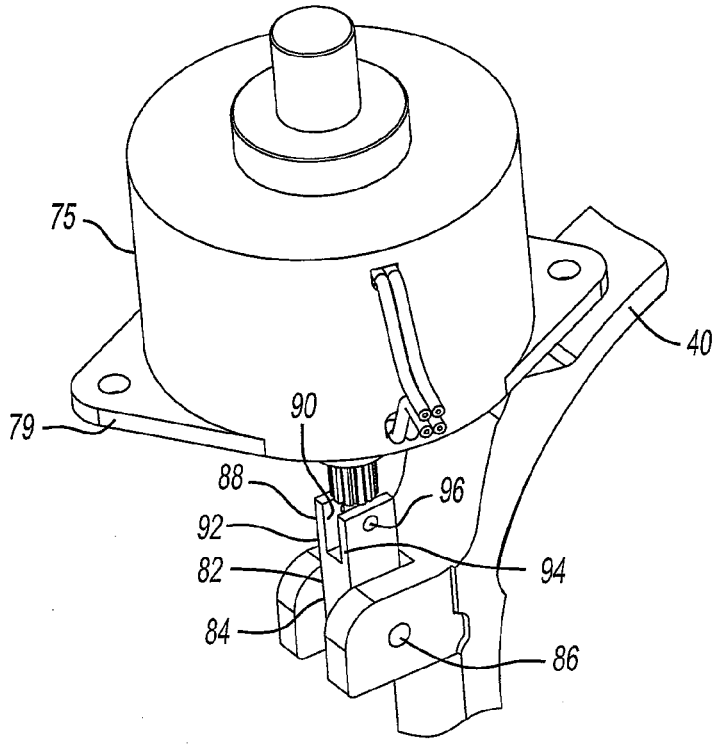
FIG. 3 is an enlarged fragmentary perspective view of the pumping system depicted in FIGS. 1 and 2.

With reference to FIGS. 1-3, a pumping system 10 is shown plumbed in communication with an exemplary power transmission device 12. Power transmission device 12 is shown schematically and may include any number of devices including an internal combustion engine, a transmission, a transfer case, an axle assembly or the like. Pumping system 10 includes a variable displacement pump 14 including a housing 16 with a flange 17 for mounting pump 14 to power transmission device 12. Alternatively, housing 16 may be integrally formed with the power transmission device. An inlet 18 extends through housing 16 interconnecting a low pressure gallery 20 with a sump 22 storing the fluid to be pumped. An outlet 24 of housing 16 interconnects a high pressure chamber 26 with power transmission device 12.

Pump 14 includes a pump rotor 28 rotatably mounted within a rotor chamber 32. A drive shaft 34 is fixed for rotation with pump rotor 28 to provide energy for pumping the lubricant. A plurality of pump vanes 36 are coupled to rotor 28 and radially slidable relative thereto. The radial outer end of each vane 36 engages an inner surface 38 of a pump control ring 40. A plurality of pumping chambers 44 are defined by inner surface 38, pump rotor 28 and vane 36. Control ring 40 includes an integrally formed pivot pin 46 positioned within a recess 48 formed in housing 16. It should be appreciated that control ring 40 may be pivotally mounted within housing 16 via many other suitable methods as well. Inner surface 38 of pump control ring 40 has a circular cross-sectional shape. An outer surface 50 of rotor 28 also has a circular cross-sectional shape. The center of surface 38 is eccentrically located with respect to the center of surface 50. Accordingly, the volume of each pumping chamber 44 changes as rotor 28 rotates. The volume of chambers 44 increases at the low pressure side of the pump in communication with inlet 18. Pumping chambers 44 decrease in size at the high pressure side in communication with outlet 24 of pump 14. The change in volume of pumping chambers 44 generates the pumping action by drawing working fluid from sump 22 and delivering pressurized fluid from outlet port 24.

The output of pump 14 may be varied by rotating pump control ring 40 about pivot pin 46. In particular, the amount of eccentricity between inner surface 38 of pump ring 40 and the outer surface 50 of rotor 28 changes as control ring 40 is rotated.

A radially outwardly protruding arm 60 is integrally formed with control ring 40 and protrudes outside of pumping chambers 44. An actuator assembly 62 is coupled to arm 60 and is operable to move control ring 40 between a first position, a second position and any point therebetween. In the first position, the control ring provides maximum eccentricity and maximum pump flow. At the second position, control ring 40 is positioned at a minimum eccentricity relative to rotor 28 and a minimum of output occurs.

To reduce the magnitude of force required to be provided by actuator assembly 62, a first pressure balance chamber 64 is formed on a first side of control ring 40 while a second pressure balance chamber 66 is formed on an opposite side of control ring 40. First pressure balance chamber 64 and second pressure balance chamber 66 are each in fluid communication with pressurized fluid provided from outlet 24. This arrangement effectively balances the forces acting on control ring 40 thereby minimizing the force required to move control ring 40 and vary the pump output. It should be appreciated that the pressure balanced arrangement may be desirable but is not a requisite portion of pumping system 10. With the pressure balancing chambers, actuator 62 may function but may be tasked to provide a greater input force to move control ring 40.

Actuator assembly 62 includes an electric stepper motor 70 including a stator 72 and a rotor 74 supported in a housing 75. Rotor 74 is coupled to a nut 76 that is threadingly engaged with an externally threaded actuator shaft 78. Housing 75 includes a flange 79 coupled to pump housing 16. Flange 79 may alternatively be fixed to power transmission device 12. Actuator shaft 78 includes a distal end 80 coupled to arm 60 by a connector 81. A yoke 82 includes a first end 84 rotatably coupled to arm 60 via a pin 86. A second end 88 of yoke 82 is bifurcated defining a slot 90 bounded by first and second fingers 92, 94. A clevis pin 96 rotatably interconnects yoke 82 and actuator shaft 78.

Figure 4:
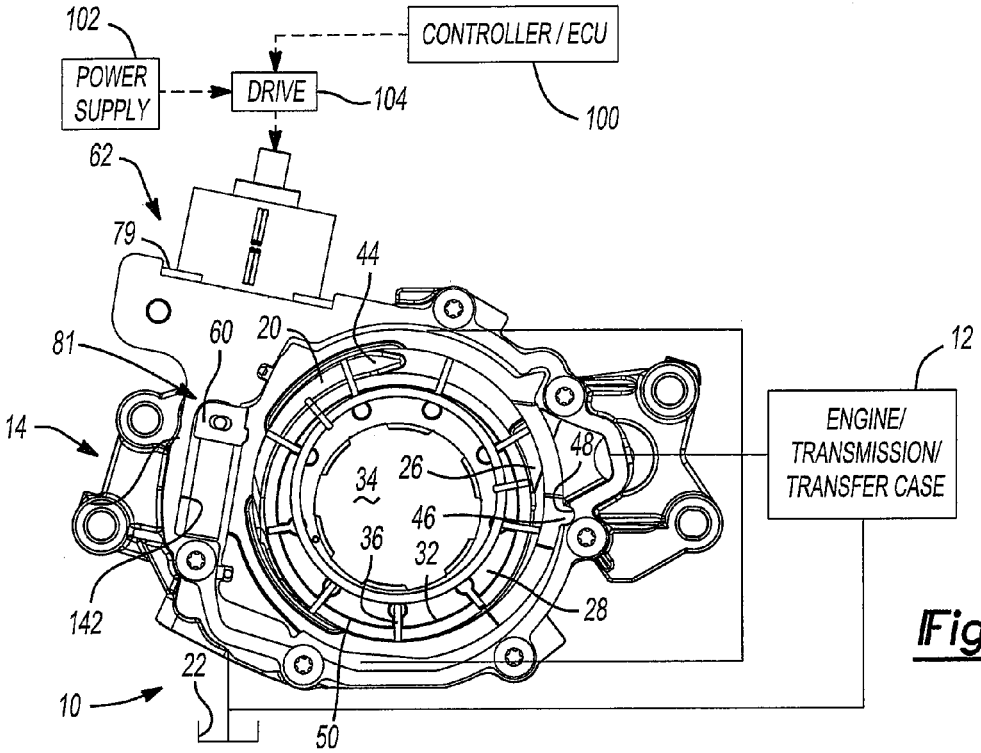
FIG. 4 is a schematic of an open loop control system for controlling the variable displacement vane pump.
Figure 5:
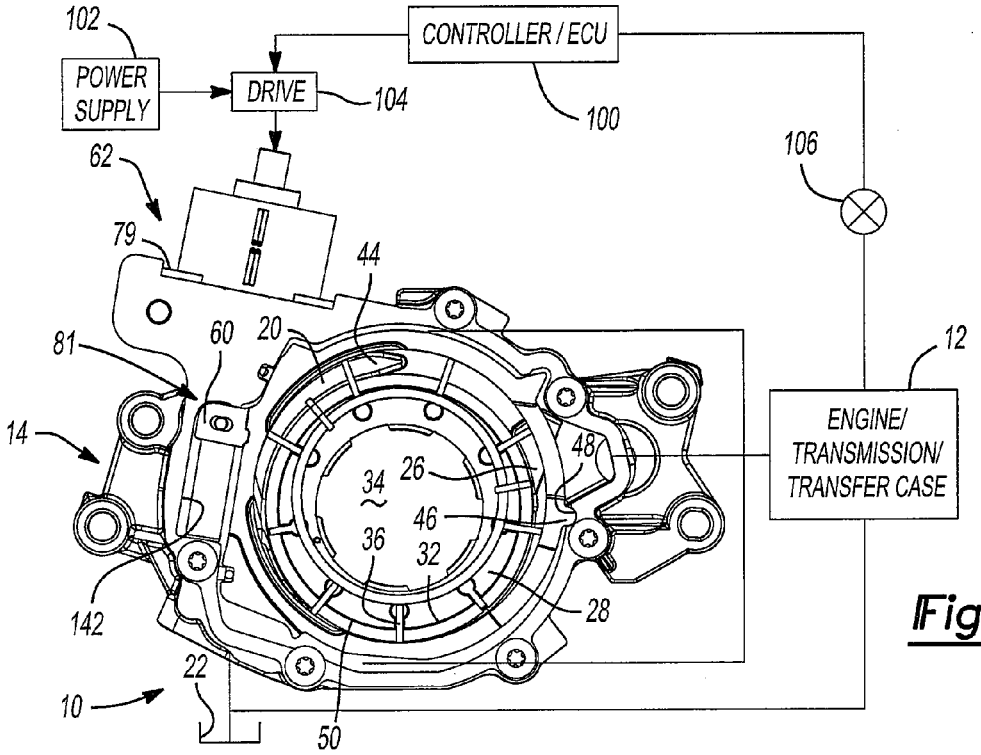
FIG. 5 is a schematic depicting a closed loop control system cooperating with the variable displacement vane pump.

Referring to FIG. 4, actuator assembly 62 is in communication with a controller 100, a power supply 102 and a drive 104. Controller 100 may be programmed with an algorithm or algorithms referencing speed, pressure, flow or temperature maps to enable the controller to control the flow of the pump using an open loop control system as depicted in FIG. 4. FIG. 5 depicts a closed loop control system including a pressure sensor 106 in communication with controller 100.

In operation, driveshaft 34 begins to rotate and drive rotor 28. Lubricant pressure and flow begin to increase at outlet 24. At start-up, controller 100 locates control ring 40 in the first position. As such, flow increases linearly with the speed of driveshaft 34. At a particular speed, the flow produced by pump 14 will exceed the lubrication requirements of power transmission device 12. At this time, controller 100 provides a signal to drive 104. Drive 104 is in receipt of electrical power from power supply 102. Drive 104 generates electrical pulses and supplies pulses to electric stepper motor 70 causing nut 76 to rotate in one of two directions to extend or retract actuator shaft 78 as signaled by controller 100. Because actuator shaft 78 is directly coupled to control ring 40, the linear motion of actuator shaft 78 changes the eccentricity of the pump and thus the pump output flow.

When the open loop control system of FIG. 4 is implemented, controller 100 continues to signal drive 104 to position control ring 40 based on any one or more of speed, pressure, flow or temperature mappings of the control algorithm. A dedicated pressure sensor associated with pump 14 is not required. Alternatively, the closed loop feedback system depicted in FIG. 5 includes pressure sensor 106 providing a signal indicative of the pressure output by pump 14 to controller 100. Controller 100 outputs a signal to drive 104 to position control ring 40 and cause pump 14 to output a desired lubricant pressure.

Figure 6:
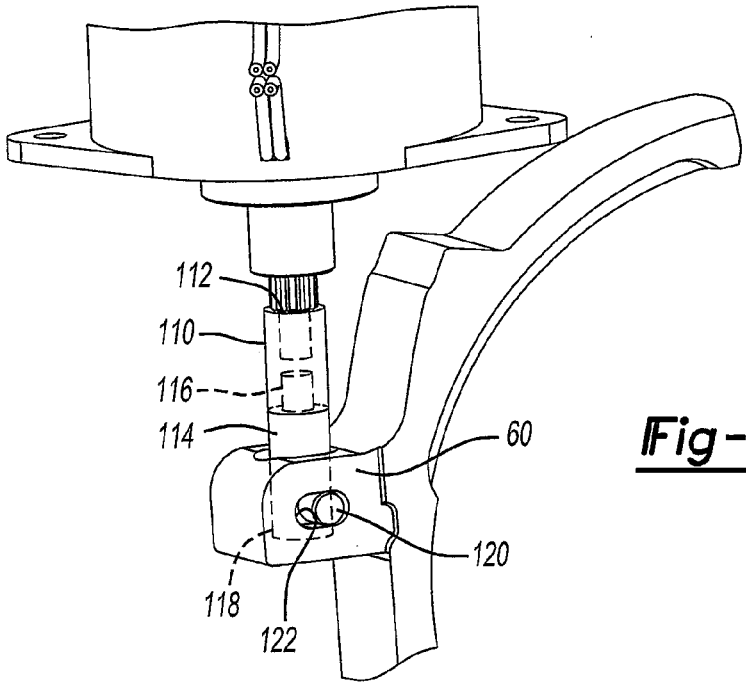
FIG. 6 is a fragmentary perspective view of an alternate connector coupling the actuator shaft and the control ring.

FIG. 6 depicts an alternate method of drivingly interconnecting actuator shaft 78 and arm 60. A threaded sleeve 110 includes a threaded throughbore 112. Actuator shaft 78 is threadingly engaged with threaded bore 112. A connector 114 includes a first end having a reduced diameter and an externally threaded portion 116 as well as another portion 118 including a transversely extending through aperture. Threaded portion 116 is engaged with threaded bore 112 to fix threaded sleeve 110 to connector 114. An elongated slot 120 extends through arm 60 in a direction substantially perpendicular to the direction of travel of actuator shaft 78. A pin 122 extends through slot 120 and the aperture formed in connector 114 to drivingly interconnect actuator shaft 78 and control ring 40 while allowing the requisite degrees of freedom to allow control ring 40 to rotate while actuator shaft 78 linearly translates.

Figure 7:
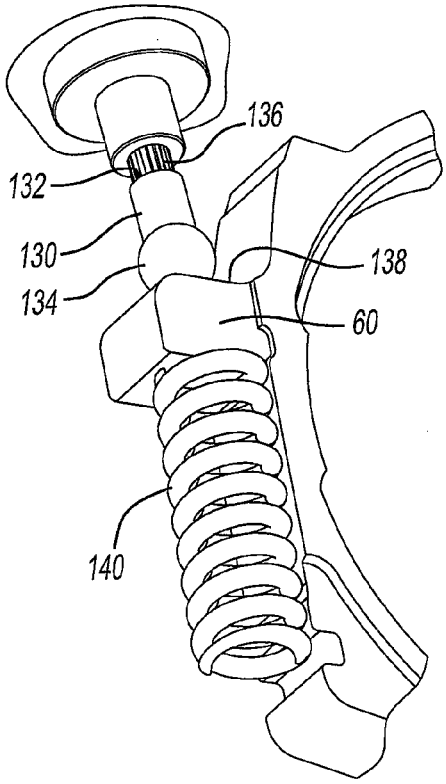
FIG. 7 is a fragmentary perspective view of another alternate connector coupling the actuator shaft and the control ring.

FIG. 7 depicts another alternate method of interconnecting actuator shaft 78 and control ring 40. A driver 130 includes one end having an internally threaded bore 132 and an opposite end having a substantially spherical outer surface 134. Threaded bore 132 is coupled to an externally threaded end 136 of actuator shaft 78. Arm 60 includes a cam surface 138 engaged by spherical surface 134 of driver 130. A spring 140 is positioned within a cavity 142 shown in FIG. 1. Spring 140 biases arm 60 into engagement with spherical surface 134. In this manner, a constant engagement between surface 138 and spherical surface 134 will be maintained throughout operation of pumping system 10. Furthermore, spring 140 urges control 40 toward the position of maximum eccentricity.

Figure 8:
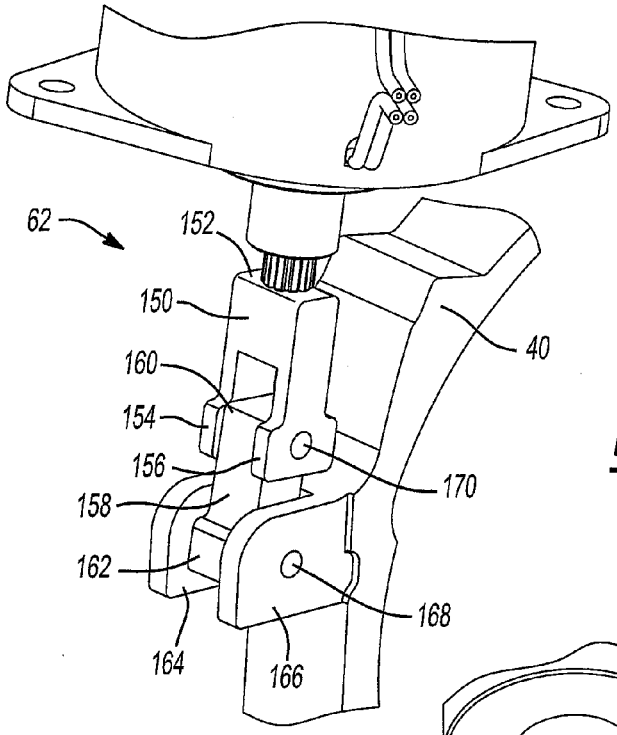
FIG. 8 is a fragmentary perspective view of another alternate connector coupling the actuator shaft and the control ring.

With reference to FIG. 8, another alternate method for interconnecting actuator shaft 78 and control ring 40 is illustrated. A clevis 150 includes a threaded internal bore 152 fixed to an externally threaded portion of actuator shaft 78. Clevis 150 includes a bifurcated end opposite threaded bore 152 including a first leg 154 spaced apart from a second leg 156. A connector 158 includes a first end 160 positioned between first leg 154 and second leg 156. A first arm 164 and a second arm 166 are integrally formed with control ring 40. A second end 162 of connector 158 is positioned between first and second arms 164, 166. A pin 168 interconnects connector 158 with control ring 40 and allows relative rotation therebetween. Once clevis 150 is threadingly engaged with actuator shaft 78 and connector 158 is pinned to control ring 40, connector 158 is rotated in alignment with clevis 150 to allow insertion of another pin 170 rotatably interconnecting connector 158 to clevis 150.

Figure 9:
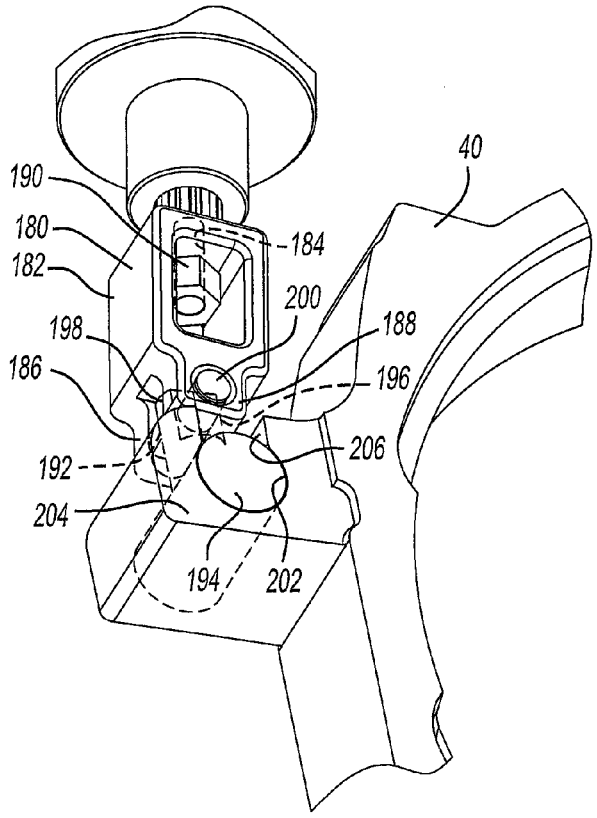
FIG. 9 is a fragmentary perspective view of another alternate connector coupling the actuator shaft and the control ring.

Another alternate interconnection method is shown in FIG. 9. A clevis 180 includes an open frame portion 182 having a through aperture 184 extending through one portion of the frame. An opposite portion of the frame includes integrally formed and spaced apart first and second legs 186, 188. A distal portion of actuator shaft 78 extends through aperture 184. A nut 190 threadingly engages an externally threaded portion of actuator shaft 78 to fix clevis 180 to actuator shaft 78. A connector 192 includes a cylindrically shaped portion 194 and a radially protruding shaft portion 196. A flattened portion 198 is formed at the distal end of shaft portion 196 and positioned between first and second legs 186, 188. A pin 200 rotatably interconnects connector 192 and clevis 180. Cylindrical portion 194 is rotatably coupled to control ring 40 by being positioned within a cylindrically shaped seat 202 of an integrally formed arm 204. Shaft portion 196 extends through a slot 206 formed in arm 204.

Figure 10:
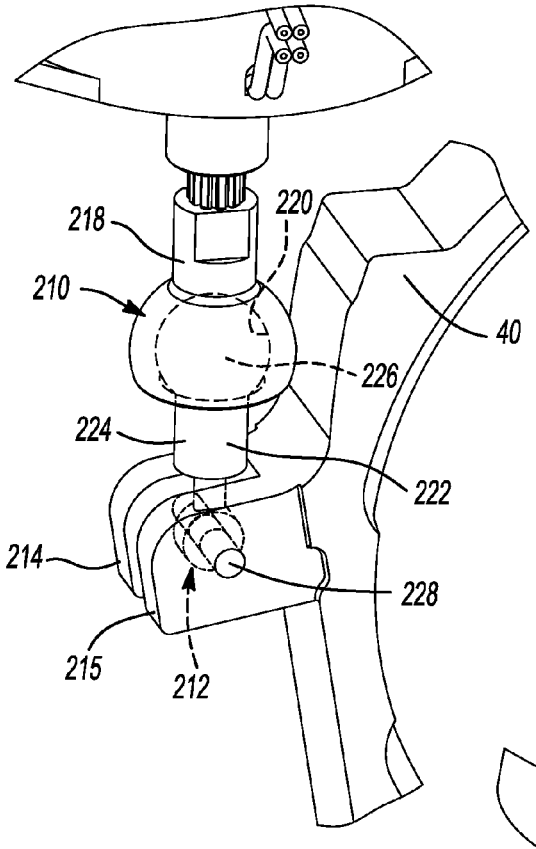
FIG. 10 is a fragmentary perspective view of another alternate connector coupling the actuator shaft and the control ring.

FIG. 10 depicts another method of interconnecting actuator shaft 78 and control ring 40. In particular, a ball joint assembly 210 and a connector 212 couple actuator shaft 78 to a bifurcated pair of arm portions 214, 215 integrally formed with control ring 40. Ball joint assembly 210 includes a socket 216 having a first end fixed to actuator shaft 78 and a second end defining a substantially spherical concave surface 220. Ball joint assembly 210 also includes a ball stud 222 including a shank 224 and a ball 226 integrally formed with each other. Ball 226 engages spherical surface 220 of socket 216. Connector 212 is threadingly engaged with shank 224 and positioned between arms 214, 215. A pin 228 rotatably interconnects connector 212 and control ring 40.

Figure 11:
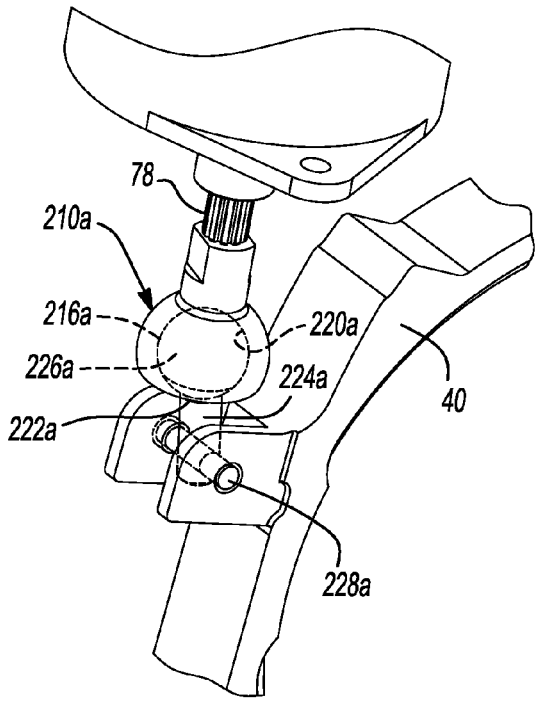
FIG. 11 is a fragmentary perspective view of another alternate connector coupling the actuator shaft and the control ring.

FIG. 11 depicts a similar connection system to that described in relation to FIG. 10. Accordingly, like elements will retain their previously introduced reference numerals including an "A" suffix. The connection system of FIG. 11 eliminates connector 212A and utilizes pin 228A to rotatably interconnect shank 224A and control ring 40.

Figure 12:
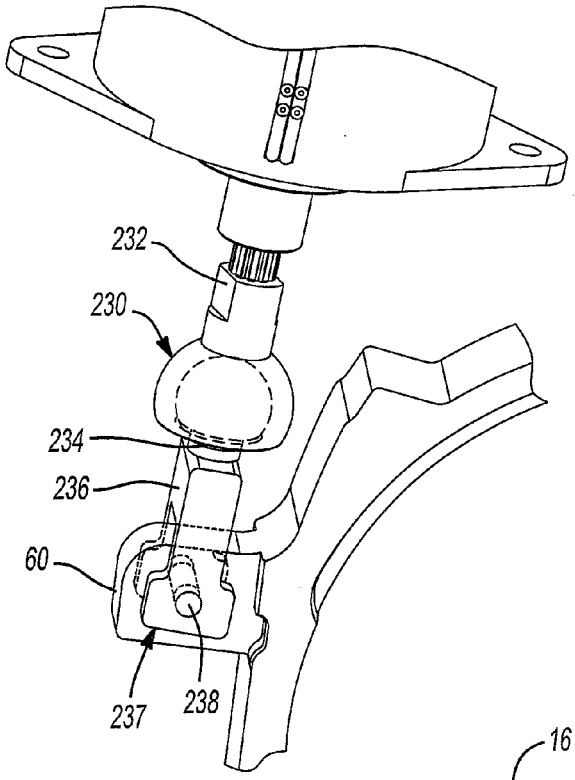
FIG. 12 is a fragmentary perspective view of another alternate connector coupling the actuator shaft and the control ring.

FIG. 12 shows another connection including a ball joint assembly 230 including a socket 232 fixed to actuator shaft 78 and a ball shank 234 fixed to a clevis 236. Ball shank 234 may be coupled to clevis 236 via a threaded interconnection or another load transferring method. Clevis 236 includes a bifurcated end 237 coupled for rotation with arm 60 by a pin 238.

Figure 13:
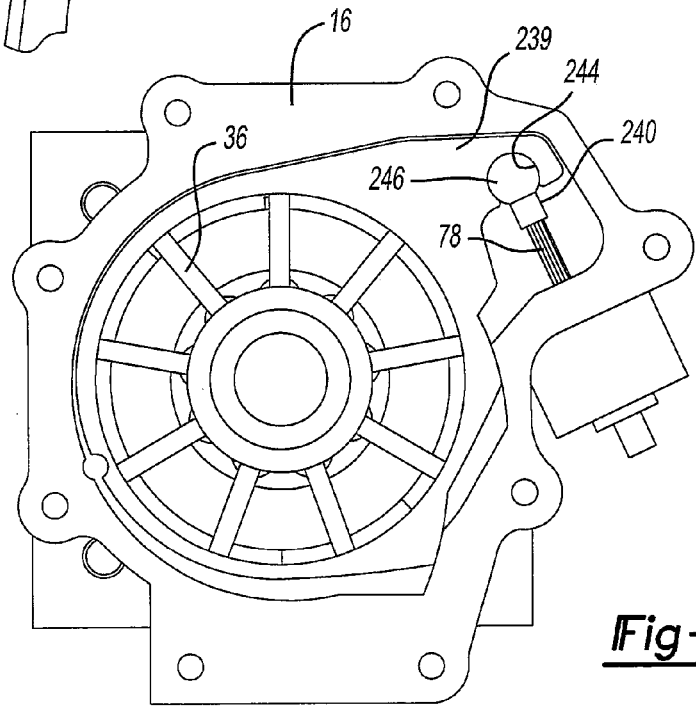
FIG. 13 is a sectional view of another alternate connector coupling the actuator shaft and the control ring.

As shown in FIG. 13, another method of drivingly interconnecting actuator shaft 78 and a control ring 239 is depicted. In this arrangement, a ball stud 240 is fixed to the distal end of actuator shaft 78. Control ring 239 includes an integrally formed pocket having a cylindrically shaped surface 244. The cylindrical surface 244 extends an arc length greater than 180 degrees to retain a spherically shaped ball 246 of ball stud 240 therein. Surface 244 extends substantially the entire width of control ring 239 to allow ball stud 240 to be inserted within the recess prior to interconnection to actuator shaft 78. Conversely, ball stud 240 may be fixed to actuator shaft 78 and then subsequently coupled to control ring 239.

Figure 14:
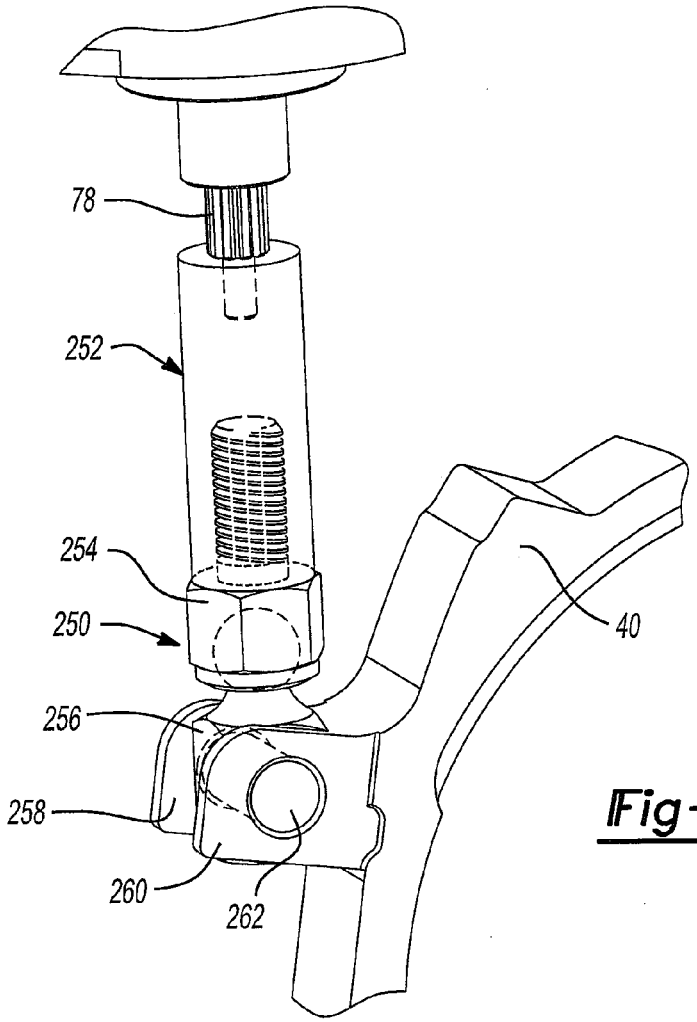
FIG. 14 is a fragmentary perspective view of another alternate connector coupling the actuator shaft and the control ring.

Yet another method for interconnecting actuator shaft 78 and control ring 40 is depicted at FIG. 14. A ball joint assembly 250 and an adapter 252 couple actuator shaft 78 to control ring 40. One end of adapter 252 is fixed to a distal end of actuator shaft 78 via a threaded connection. An opposite end of adapter 252 is coupled to a socket 254 of ball joint assembly 250 via another threaded interconnection. A ball stud 256 extends between bifurcated arms 258, 260 of control ring 40. A pin 262 rotatably interconnects ball shank 256 with control ring 40.

A number of coupling techniques have been described to facilitate a ridged mounting of actuator housing 75 to pump housing 16 or another portion of power transmission device 12. The connection provides sufficient degrees of freedom to allow actuator shaft 78 to linearly translate and transfer a force to the pivotally moveable control ring 40. While many of the interconnections have been described as threaded couplings, it should be appreciated that any number of methods for fixing two components relative to one another such as pinning, riveting, welding, press-fitting, adhesive bonding or the like, are contemplated as being within the scope of the present disclosure. Furthermore, while the closed loop control system was previously described as being in communication with a pressure sensor, it should be appreciated that any number of other sensors may be implemented to provide controller 100 with data for decision making relating to the control of actuator 62 and pumping system 10.

Furthermore, the foregoing discussion discloses and describes merely exemplary embodiments of the present disclosure. One skilled in the art will readily recognize from such discussion, and from the accompanying drawings and claims, that various changes, modifications and variations may be made therein without departing from the spirit and scope of the disclosure as defined in the following claims.

What is claimed is:

1. A lubrication system for a power transmission device, comprising:

a variable displacement vane pump having a pivotable pump control ring for varying the displacement of the pump; and a control system operable to vary the displacement of the pump during operation of the pump to achieve an output pressure selected from a continuously variable range of output pressures from the pump which are independent from the operating speed of the pump, the control system including a linear actuator coupled to the control ring for moving the control ring between minimum and maximum pump displacement positions, the linear actuator including an electric stepper motor for bi-directionally rotating a nut threadingly engaged with an axially moveable actuator shaft and a coupler interconnecting the actuator shaft and the control ring, the coupler having multiple degrees of freedom to allow concurrent axial movement of the actuator shaft and rotation of the control ring.

2. The lubrication system of claim 1 further including a first control chamber being in receipt of pressurized working fluid and operable to create a force on the pump control ring to urge the pump control ring towards the position of minimum displacement, and a second control chamber being in receipt of pressurized working fluid and operable to create a force on the pump control ring to urge the pump control ring towards the position of maximum displacement, wherein the resultant force on the pump ring approaches zero.

3. The lubrication system of claim 2 wherein the control system includes a controller in communication with a drive providing electrical pulses to the stepper motor.

4. The lubrication system of claim 1 further including a biasing spring to urge the pump control ring toward the maximum displacement position.

5. The lubrication system of claim 1 wherein the coupler includes a link rotatably coupled to each of the actuator shaft and the control ring.

6. The lubrication system of claim 5 wherein each of the control ring and the link include bifurcated ends.

7. The lubrication system of claim 1 wherein the coupler includes a link fixed to the actuator shaft and a pin slidably positioned within a slot formed in the control ring, the pin pivotally interconnecting the link and the control ring.

8. The lubrication system of claim 1 wherein the coupler includes a ball stud having an end fixed to the actuator shaft and a substantially spherically shaped opposite end in engagement with the control ring.

9. The lubrication system of claim 8 further including a spring biasing the control ring toward the maximum displacement position and maintaining contact between the spherically shaped end and the control ring.

10. The lubrication system of claim 8 wherein the spherically shaped ball engages a cam surface of a radially outwardly extending arm integrally formed with the control ring.

11. The lubrication system of claim 8 wherein the spherically shaped ball is retained within a partially cylindrically shaped recess formed in the control ring.

12. The lubrication system of claim 11 wherein the partially cylindrically shaped recess extends an arc length greater than one hundred and eighty degrees to restrict withdrawal of the ball from the recess.

13. The lubrication system of claim 1 wherein the coupler includes a ball joint assembly.

14. The lubrication system of claim 13 wherein the ball joint assembly includes a first member including a threaded first end coupled to the actuator shaft and an opposite second end including one of a ball and a socket, the ball joint assembly further including a second member having a first end pivotally coupled to the control ring and a second end including the other of the ball and socket.

15. The lubrication system of claim 14 wherein the first end of the second member is bifurcated.

16. The lubrication system of claim 15 wherein the control ring includes an outwardly extending arm positioned between portions of the bifurcated first end.

17. The lubrication system of claim 16 wherein the coupler includes a pin connecting the arm and the bifurcated first end.

18. A lubrication system for a power transmission device, comprising:

a variable displacement vane pump including a moveable control ring for varying the displacement of the pump;

a linear actuator directly acting on the control ring for moving the control ring between maximum and minimum pump displacement positions, the linear actuator including an electric motor for rotating a drive member, the drive member engaging a driven actuator shaft to cause linear translation of the actuator shaft in response to rotation of the drive member, the linear actuator further including a coupler interconnecting the actuator shaft and the control ring; and a control system including a controller for signaling the actuator to extend or retract the actuator shaft to vary the pump displacement, wherein the controller operates in an open loop control mode and is not in receipt of a signal indicative of the pressure being output by the pump.

19. The lubrication system of claim 18 wherein the electric motor is a stepper motor operable to position the control ring at various positions between the minimum and maximum displacement positions.

20. A lubrication system for a power transmission device, comprising:

a variable displacement vane pump including a housing containing a moveable control ring for varying the displacement of the pump;

a linear actuator directly acting on the control ring for moving the control ring between maximum and minimum pump displacement positions, the linear actuator including an electric motor for rotating a drive member, the drive member engaging a driven actuator shaft to cause linear translation of the actuator shaft in response to rotation of the drive member, the linear actuator further including a coupler interconnecting the actuator shaft and the control ring;

a control system including a controller for signaling the actuator to extend or retract the actuator shaft to vary the pump displacement;

a first control chamber positioned between the housing and an outer surface of the pump control ring and being in receipt of pressurized working fluid and operable to create a force on the pump control ring to urge the pump control ring towards the position of minimum displacement; and a second control chamber positioned between the housing and the outer surface of the pump control ring and being in receipt of pressurized working fluid and operable to create a force on the pump control ring to urge the pump control ring towards the position of maximum displacement, wherein the resultant force on the pump ring approaches zero.

21. The lubrication system of claim 20 wherein the pump ring is pivotable between the minimum and maximum displacement positions.

22. The lubrication system of claim 21 wherein the coupler includes a ball joint assembly interconnecting the actuator shaft and the control ring.

* * * * *